United States Patent [19]

Forster et al.

[11] Patent Number: 4,485,931

[45] Date of Patent: Dec. 4, 1984

[54] CENTRAL BUFFER COUPLING FOR RAIL VEHICLES

[75] Inventors: Hilmar Forster, Wolfenbuttel; Ernst Vahldiek, Beierstedt; Dildar Arbab, Salzgitter, all of Fed. Rep. of Germany

[73] Assignee: Scharfenbergkupplung GmbH, Fed. Rep. of Germany

[21] Appl. No.: 455,485

[22] Filed: Jan. 4, 1983

[30] Foreign Application Priority Data

Apr. 14, 1982 [DE] Fed. Rep. of Germany ..... 3213697

[51] Int. Cl.[3] ..... B61G 5/02

[52] U.S. Cl. ..... 213/4; 403/100; 403/102; 403/325; 403/341

[58] Field of Search ..... 403/100, 102, 341, 325; 285/312, 316; 213/4, 18, 12, 74, 77, 78, 79, 80, 85, 86, 87, 96, 97, 98, 182, 183, 184, 185, 187, 188

[56] References Cited

U.S. PATENT DOCUMENTS

| | | | |
|---|---|---|---|
| 57,656 | 9/1866 | Alden . | |
| 1,196,952 | 9/1916 | Hubbard | 403/102 X |
| 1,985,379 | 12/1934 | Maconaghie | 213/188 |
| 2,066,182 | 12/1936 | Lenz | 403/100 |
| 3,710,823 | 1/1973 | Vik | 285/316 X |

FOREIGN PATENT DOCUMENTS

| | | | |
|---|---|---|---|
| 519693 | 12/1955 | Canada | 403/325 |
| 848738 | 11/1939 | France | 285/312 |
| 10330 | of 1913 | United Kingdom | 403/341 |

*Primary Examiner*—Cornelius J. Husar
*Assistant Examiner*—Joseph A. Fischetti
*Attorney, Agent, or Firm*—McGlew and Tuttle

[57] ABSTRACT

A buffer coupling for rail vehicles comprises a first coupling part which has a receiving shoulder adjacent its end with a first cylindrical portion spaced from the end of said first coupling part of increased diameter from said shoulder and forming a rib in a second cylindrical portion of smaller diameter than the rib forming a cylindrical slide surface over which a sleeve is slidable. The sleeve is urged away from the rib by a spring so that it projects outwardly from the second cylindrical portion of smaller diameter so that it may engage over respective legs of a forked end of the second coupling part which engages with the first coupling part so that the shoulder of the first part fits within the legs of the second coupling part. The sleeve is urged by the spring to engage over the outer cylindrical surface of the second coupling part. The leg portions of the forked end of the second part have openings which align vertically with an opening of the shoulder of the first part and a vertical bolt extends through the aligned openings and pivotlly interconnects the two coupling parts. A cam is engaged on the bolt and is rotatable and has surfaces engagable with the sleeve to urge it in a direction against the biasing of the spring to a position in which this sleeve no longer overlies the bifurcated end of the second coupling part and permits pivotal movement of the two coupling parts.

4 Claims, 4 Drawing Figures

CENTRAL BUFFER COUPLING FOR RAIL VEHICLES

FIELD AND BACKGROUND OF THE INVENTION

The invention relates particularly to a central buffer coupling for rail vehicles, the coupling bar of which together with the coupling head is pivotally articulated to the vehicle frame, the coupling bar being of two-part design and the articulated connection of the two parts being effected by a vertical bolt around which the coupling head can swivel.

In the known central buffer couplings, the coupling head stands out over the vehicle contour. For rail vehicles which do not have a separate track, such as trolley cars, this means a danger to the rest of the traffic.

SUMMARY OF THE INVENTION

The invention provides a central buffer coupling which can be pivoted into the vehicle contour, and where, for coupling, the tie rod forms a rigid unit, to be able to absorb the buffer impacts occurring during coupling.

According to the invention, one part of a coupling carries a displaceable sleeve under the action of springs which secures the two parts as a unit, and that the bolt has a cam plate by means of which the sleeve is pushed back to release the coupling head for pivoting and is fixed in this position.

Accordingly, it is an object of the invention to provide a coupling which includes a sleeve which extends over the two coupling parts and prevents the rotation of the parts which can be displaced by a cam member carried on a bolt which pivotally interconnects the parts to free the two coupling parts for pivotal motion.

A further object of the invention is to provide a buffer coupling which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 4:
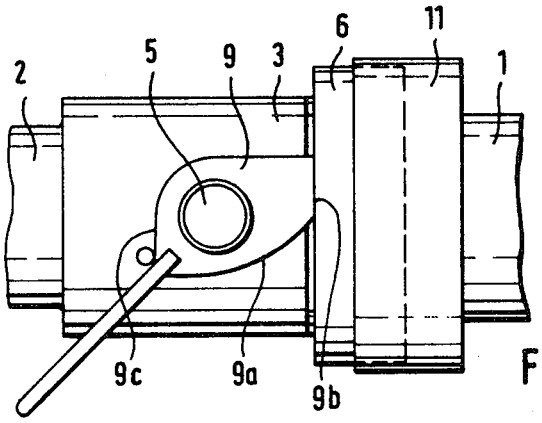
FIG. 4 is a view similar to FIG. 3 showing the parts in position in which the coupling parts may pivot relatively to each other.

Referring to the drawings, in particular the invention embodied therein comprises a buffer coupling for rail vehicles which comprises a first coupling part 1 having a receiving shoulder 4 adjacent its end with a first cylindrical portion spaced from the end and having an increased diameter from said shoulder and forming a rib 8. A second cylindrical portion of smaller diameter than the rib 8 forms a cylindrical slide surface over which a sleeve 6 is slidably engaged. A second coupling part 2 has a forked end 3 with spaced apart legs which engage on respective opposite surfaces of the shoulder 4. The second coupling part 2 has an exterior cylindrical surface over which sleeve 6 engages under the action of biasing springs 7 (only one is shown). The legs of the forked end 3 and the shoulder 4 have openings which align vertically to accommodate a vertically extending bolt 5 which pivotally interconnects the coupling parts 1 and 2. Springs 7 urge sleeve 6 in a direction to project from coupling part 1 and engage over the exterior of the coupling part 2. In accordance with the invention, cam means in the form of a cam 9 is mounted for rotation about the axis of the bolt 5 and is engageable with the sleeve 6 to move it against the biasing of the spring 7 so as to move it to an end position as shown in FIG. 4 in which the two coupling parts are released for pivoting.

Figure 1:
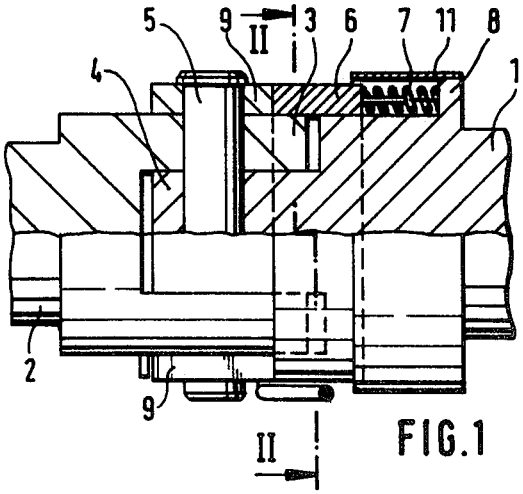
FIG. 1 is a partial side elevational and selectional view of a coupling constructed in accordance with the invention.
Figure 2:
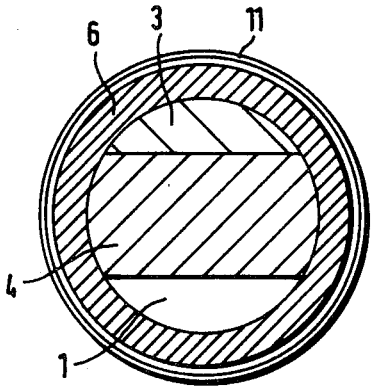
FIG. 2 is a section taken along the lines II—II of FIG. 1.
Figure 3:
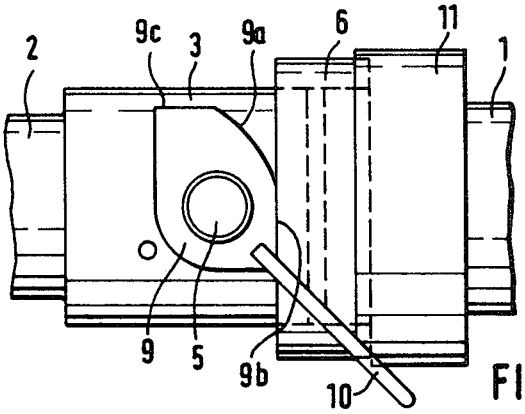
FIG. 3 is a top view of the coupling shown in FIG. 1.

The coupling bar consists of the first part 1 carrying a coupling head, and of the second part 2 hinged to the vehicle frame for horizontal movement, the free end of which is formed as the fork 3 which embraces the shoulder 4 of part 1 on the top and bottom sides. By the bolt 5 through fork 3 and shoulder 4, the parts 1 and 2 are coupled together in such a way that part 1 can swivel horizontally relative to part 2. The outer faces of parts 1 and 2 and of fork 3 are formed so that a circular cross-section results. Part 1 is surrounded by sleeve 6, which is pushed over and beyond fork 3 by compression springs 7, the abutment of which is formed by rib 8 extending all around. By cam plates 9 formed identically at the ends of bolt 5 the stroke of sleeve 6 is limited. Cam plate 9 is designed so as to have a curved face **9*a* which is limited by plane faces 9*b* and 9*c*, which are disposed at an angle to it, the faces 9*a* and 9*b* being at different distances from the center of the bolt. In the locked disposition of parts 1 and 2 according to FIG. 1, sleeve 6 abuts face 9*b*, which is at a smaller distance from bolt 5. The springs 7 are covered outwardly by a cap 11 secured on rib 8. To swivel part 1 and hence the coupling head, cam plate 9 is rotated clockwise by means of a handle 10. Simultaneously and uniformly with the rotation of the cam plate 9, sleeve 6 is pushed back, due to the form of the cam face 9*a* in conjunction with the greater distance of face 9*c* from bolt 5, counter to the force of the springs 7 out of the overlap of fork 3 until face 9*c* applies against sleeve 6. The coupling head can now be pivoted horizontally, leaving face 9*c* in abutment with sleeve 6** during this swivel movement.

After return of the coupling head to the position ready for coupling, cam plate 9 is rotated back counterclockwise until sleeve 6 comes into the zone of cam face **9*a*. Thereupon the turning back of the cam plate and the overlapping of fork 3 is effected exclusively by sleeve 6**.

While a specific embodiment of the invention has been shown and described in detail to illustrate the application of the principles of the invention, it will be understood that the invention may be embodied otherwise without departing from such principles.

What is claimed is:

1. In combination with a rail vehicle frame and coupling head, a buffer coupling comprising a first coupling part connected to one of the frame and head and having a receiving shoulder adjacent one end thereof with a first cylindrical portion spaced from the one end having an increased diameter from said shoulder and forming a rib, a second cylindrical portion of smaller diameter than said rib forming a cylindrical slide surface, a sleeve slidably engaged on said slide surface, a second coupling part connected to the other of the frame and head and having a forked end with spaced apart legs engaged on respective sides of said shoulder, said legs and said shoulder having openings therethrough which align vertically, said second coupling part having an exterior cylindrical surface over which said sleeve engages, a vertical bolt extending through the vertically aligned openings and pivotally interconnecting said first and second coupling parts, spring means urging said sleeve in a direction to project from said slide surface of said first coupling part and to engage over the exterior of said second coupling part, and cam means carried by said second coupling part engageable with said sleeve to move it against said spring means beyond an end of said second coupling part to release said first and second coupling parts for pivoting.

2. A buffer according to claim 1, wherein said cam means includes a cam plate which is rotatable about the axis of said bolt and having surfaces at its periphery defining stop faces which may abut against said sleeve for positioning said sleeve at a selected location in respect to the end of said first and second coupling parts.

3. A buffer according to claim 1, wherein said cam means comprises a cam member having at least two flat surfaces on its periphery with a curved face extending between said flat surfaces, said cam plate being rotatable to position a selected flat surface against said sleeve, said flat surfaces being at spaced locations from the center of rotation of said cam.

4. A buffer according to claim 2 including a handle connected to said cam plate.

* * * * *